US008470102B2

(12) United States Patent
Bertrand et al.

(10) Patent No.: US 8,470,102 B2
(45) Date of Patent: Jun. 25, 2013

(54) PROCESS FOR MANUFACTURING A GALVANIZED OR A GALVANNEALED STEEL SHEET BY DFF REGULATION

(75) Inventors: Florence Bertrand, Scy-Chazelles (FR); Didier Huin, Nancy (FR); Hubert Saint-Raymond, Metz (FR)

(73) Assignee: ArcelorMittal France, Saint Denis (FR)

( * ) Notice: Subject to any disclaimer, the term of this patent is extended or adjusted under 35 U.S.C. 154(b) by 600 days.

(21) Appl. No.: 12/666,676

(22) PCT Filed: Jun. 11, 2008

(86) PCT No.: PCT/IB2008/001494

§ 371 (c)(1),
(2), (4) Date: Apr. 12, 2010

(87) PCT Pub. No.: WO2009/004426

PCT Pub. Date: Jan. 8, 2009

(65) Prior Publication Data

US 2010/0186854 A1 Jul. 29, 2010

(30) Foreign Application Priority Data

Jun. 29, 2007 (EP) ..... 07290813

(51) Int. Cl.
*C23C 22/02* (2006.01)
*C23C 22/00* (2006.01)

(52) U.S. Cl.
USPC ..... 148/533; 148/277; 148/284; 148/287; 148/276; 427/433; 427/321; 428/659

(58) Field of Classification Search
USPC ..... 148/276, 277, 284, 287, 533; 427/433, 427/321; 428/659
See application file for complete search history.

(56) References Cited

U.S. PATENT DOCUMENTS

| | | | | |
|---|---|---|---|---|
| 4,437,905 | A | 3/1984 | Nitto et al. | |
| 2003/0047255 | A1 | 3/2003 | Delaunay et al. | |
| 2006/0292391 | A1 | 12/2006 | Ikematsu et al. | |
| 2008/0023111 | A1 * | 1/2008 | Nakanishi et al. | 148/284 |

FOREIGN PATENT DOCUMENTS

| | | | |
|---|---|---|---|
| BE | 1014997 | * | 8/2004 |
| EP | 1 612 288 | | 1/2006 |
| GB | 1 170 057 | | 11/1969 |
| WO | 2006 061151 | | 6/2006 |
| WO | 2007 064172 | | 6/2007 |

OTHER PUBLICATIONS

U.S. Appl. No. 12/666,702, filed Dec. 24, 2009, Mataigne, et al.
U.S. Appl. No. 12/666,701, filed Dec. 24, 2009, Mataigne, et al.

* cited by examiner

*Primary Examiner* — Lois Zheng
(74) *Attorney, Agent, or Firm* — Davidson, Davidson & Kappel, LLC

(57) ABSTRACT

The invention deals with a process for manufacturing a hot-dip galvanized or galvannealed steel sheet having a TRIP microstructure, said process comprising the steps consisting in: -providing a steel sheet whose composition comprises, by weight: 0.01≦C≦0.22%, 0.50≦Mn≦2.0%, 0.2≦Si≦2.0%, 0.005≦Al≦2.0%, Mo<1.0%, Cr≦1.0%, P<0.02%, Ti≦0.20%, V≦0.40%, Ni≦1.0%, Nb≦0.20%, the balance of the composition being iron and unavoidable impurities resulting from the smelting, -oxidizing said steel sheet in a direct flame furnace where the atmosphere comprises air and fuel with an air-to-fuel ratio between 0.80 and 0.95, so that a layer of iron oxide having a thickness from 0.05 to 0.2 μm is formed on the surface of the steel sheet, and an internal oxide of Si and/or Mn and/or Al is formed, -reducing said oxidized steel sheet, at a reduction rate from 0.001 to 0.010 μm/s, in order to achieve a reduction of the layer of iron oxide, -hot-dip galvanising said reduced steel sheet to form a zinc-coated steel sheet, and -optionally, subjecting said hot-dip coated steel sheet to an alloying treatment to form a galvannealed steel sheet.

17 Claims, No Drawings

PROCESS FOR MANUFACTURING A GALVANIZED OR A GALVANNEALED STEEL SHEET BY DFF REGULATION

The present invention relates to a process for manufacturing a hot-dip galvanized or galvannealed steel sheet having a TRIP microstructure.

To meet the requirement of lightening power-driven ground vehicle structures, it is known to use TRIP steels (the term TRIP standing for transformation-induced plasticity), which combine very high mechanical strength with the possibility of very high levels of deformation. TRIP steels have a microstructure comprising ferrite, residual austenite and optionally martensite and/or bainite, which allows them to achieve tensile strength from 600 to 1000 MPa. This type of steel is widely used for production of energy-absorbing parts, such as for example structural and safety parts such as longitudinal members and reinforcements.

Before the delivery to car-makers, steel sheets are coated with a zinc-based coating generally performed by hot-dip galvanizing, in order to increase the resistance to corrosion. After leaving the zinc bath, galvanized steel sheets are often submitted to an annealing which promotes the alloying of the zinc coating with the iron of the steel (so-called galvannealing). This kind of coating made of a zinc-iron alloy offers a better weldability than a zinc coating.

Most of TRIP steel sheets are obtained by adding a large amount of silicon to steel. Silicon stabilizes the ferrite and the austenite at room temperature, and prevents residual austenite from decomposing to form carbide. However, TRIP steel sheets containing more than 0.2% by weight of silicon, are galvanized with difficulty, because silicon oxides are formed on the surface of the steel sheet during the annealing taking place just before the coating. These silicon oxides show a poor wettability toward the molten zinc, and deteriorate the plating performance of the steel sheet.

The use of TRIP steel having low silicon content (less than 0.2% by weight) can also be a solution to solve the above problem. However, this has a major drawback: a high level of tensile strength, that is to say about 800 MPa, can be achieved only if the content of carbon is increased. But, this has the effect to lower the mechanical resistance of the welded points.

On the other hand, the alloying rate during the galvannealing process is strongly slowed down whatever the TRIP steel composition because of external selective oxidation acting as a diffusion barrier to iron, and the temperature of the galvannealing has to be increased. The increase of the temperature of the galvannealing is detrimental to the preservation of the TRIP effect because of the decomposition of the residual austenite at high temperature. In order to preserve the TRIP effect, a large quantity of molybdenum (more than 0.15% by weight) has to be added to the steel, so that the precipitation of carbide can be delayed. However, this has an effect on the cost of the steel sheet.

Indeed, the TRIP effect is observed when the TRIP steel sheet is being deformed, as the residual austenite is transformed into martensite under the effect of the deformation, and the strength of the TRIP steel sheet increases.

The purpose of the present invention is therefore to remedy the aforementioned drawbacks and to propose a process for hot-dip galvanizing or galvannealing a steel sheet having a high silicon content (more than 0.2% by weight) and a TRIP microstructure showing high mechanical characteristics, that guarantees a good wettability of the surface steel sheet and no non-coated portions, and thus guarantees a good adhesion and a nice surface appearance of the zinc alloy coating on the steel sheet, and that preserves the TRIP effect.

The subject of the invention is a process for manufacturing a hot-dip galvanized or galvannealed steel sheet having a TRIP microstructure comprising ferrite, residual austenite and optionally martensite and/or bainite, said process comprising the steps consisting in:

providing a steel sheet whose composition comprises, by weight:

$0.01 \leqq C \leqq 0.22\%$
$0.50 \leqq Mn \leqq 2.0\%$
$0.2 \leqq Si \leqq 2.0\%$
$0.005 \leqq Al \leqq 2.0\%$
$Mo < 1.0\%$
$Cr \leqq 1.0\%$
$P < 0.02\%$
$Ti \leqq 0.20\%$
$V \leqq 0.40\%$
$Ni \leqq 1.0\%$
$Nb \leqq 0.20\%$, the balance of the composition being iron and unavoidable impurities resulting from the smelting, oxidizing said steel sheet in a direct flame furnace where the atmosphere comprises air and fuel with an air-to-fuel ratio between 0.80 and 0.95, so that a layer of iron oxide having a thickness from 0.05 to 0.2 μm is formed on the surface of the steel sheet, and an internal oxide of at least one type of oxide selected from the group consisting of Si oxide, Mn oxide, Al oxide, complex oxide comprising Si and Mn, complex oxide of Si and Al, complex oxide of Mn and Al, and complex oxide comprising Si, Mn and Al is formed, reducing said oxidized steel sheet, at a reduction rate from 0.001 to 0.010 μm/s in order to completely reduce the layer of iron oxide, hot-dip galvanising said reduced steel sheet to form a zinc-based coated steel sheet, and optionally, subjecting said zinc-based coated steel sheet to an alloying treatment to form a galvannealed steel sheet.

In order to obtain the hot-dip galvanized or galvannealed steel sheet having a TRIP microstructure according to the invention, a steel sheet comprising the following elements is provided:

Carbon with a content between 0.01 and 0.22% by weight. This element is essential for obtaining good mechanical properties, but it must not be present in too large amount in order not to tear the weldability. To encourage hardenability and to obtain a sufficient yield strength $R_e$, and also to form stabilized residual austenite the carbon content must not be less than 0.01% by weight. A bainitic transformation takes place from an austenitic microstructure formed at high temperature, and ferrite/bainite lamellae are formed. Owing to the very low solubility of carbon in ferrite compared with austenite, the carbon of the austenite is rejected between the lamellae. Owing to silicon and manganese, there is very little precipitation of carbide. Thus, the interlamellar austenite is progressively enriched with carbon without any carbides being precipitated. This enrichment is such that the austenite is stabilized, that is to say the martensitic transformation of this austenite does not take place upon cooling down to room temperature.

Manganese with a content between 0.50 and 2.0% by weight. Manganese promotes hardenability, making it possible to achieve a high yield strength $R_e$. Manganese promotes the formation of austenite, contributes to reducing the martensitic transformation start temperature Ms and to stabilizing the austenite. However, it is necessary to avoid the steel having too high a manganese content in order to prevent segregation, which may be demonstrated during heat treatment of the steel sheet. Furthermore, an excessive addition of manganese causes the formation of a thick internal manganese oxide layer which causes brittleness, and the adhesion of the zinc based coating will not be sufficient.

Silicon with a content between 0.2 and 2.0% by weight. Preferably, the content of silicon is higher than 0.5% by weight. Silicon improves the yield strength $R_e$ of the steel. This element stabilizes the ferrite and the residual austenite at room temperature. Silicon inhibits the precipitation of cementite upon cooling from austenite, considerably retarding the growth of carbides. This stems from the fact that the solubility of silicon in cementite is very low and the fact that silicon increases the activity of the carbon in austenite. Thus, any cementite nucleus that forms will be surrounded by a silicon-rich austenitic region, and will have been rejected to the precipitate-matrix interface. This silicon-enriched austenite is also richer in carbon, and the growth of the cementite is slowed down because of the reduced diffusion resulting from the reduced carbon gradient between the cementite and the neighbouring austenitic region. This addition of silicon therefore contributes to stabilizing an amount of residual austenite sufficient to obtain a TRIP effect. During the annealing step to improve the wettability of the steel sheet, internal silicon oxides and complex oxide comprising silicon and manganese are formed and dispersed under the surface of the sheet. However, an excessive addition of silicon causes the formation of a thick internal silicon oxide layer and possibly complex oxide comprising silicon and/or manganese and/or aluminium which causes brittleness and the adhesion of the zinc based coating will not be sufficient.

Aluminium with a content between 0.005 and 2.0% by weight. Like the silicon, aluminium stabilizes ferrite and increases the formation of ferrite as the steel sheet cools down. It is not very soluble in cementite and can be used in this regard to avoid the precipitation of cementite when holding the steel at a bainitic transformation temperature and to stabilize the residual austenite. However, a minimum amount of aluminium is required in order to deoxidize the steel.

Molybdenum with a content less than 1.0. Molybdenum favours the formation of martensite and increases the corrosion resistance. However, an excess of molybdenum may promote the phenomenon of cold cracking in the weld zones and reduce the toughness of the steel.

When a hot-dip galvannealed steel sheet is wished, conventional process requires the addition of Mo to prevent carbide precipitation during re-heating after galvanizing. Here, thanks to the internal oxidation of silicon and manganese, the alloying treatment of the galvanized steel sheet can be performed at a lower temperature than that of conventional galvanized steel sheet comprising no internal oxide. Consequently, the content of molybdenum can be reduced and be less than 0.01% by weight, because it is not necessary to delay the bainitic transformation as it is the case during the alloying treatment of conventional galvanized steel sheet.

Chromium with a content not exceeding 1.0% by weight. The chromium content must be limited in order to avoid surface appearance problems when galvanizing the steel Phosphorus with a content less than 0.02% by weight, and preferably less than 0.015% by weight. Phosphorus in combination with silicon increases the stability of the residual austenite by suppressing the precipitation of carbides.

Titanium with a content not exceeding 0.20% by weight. Titanium improves the yield strength of $R_e$, however its content must be limited to 0.20% by weight in order to avoid degrading the toughness.

Vanadium with a content not exceeding 0.40% by weight. Vanadium improves the yield strength of $R_e$ by grain refinement, and improves the weldability of the steel. However, above 0.40% by weight, the toughness of the steel is degraded and there is a risk of cracks appearing in the weld zones.

Nickel with a content not exceeding 1.0% by weight. Nickel increases the yield strength of $R_e$. Its content is generally limited to 1.0% by weight because of its high cost.

Niobium with a content not exceeding 0.20% by weight. Niobium promotes the precipitation of carbonitrides, thereby increasing the yield strength of $R_e$. However, above 0.20% by weight, the weldability and the hot formability are degraded.

The balance of the composition consists of iron and other elements that are usually expected to be found and impurities resulting from the smelting of the steel, in proportions that have no influence on the desired properties.

The steel sheet having the above composition is first subjected to an oxidation followed by a slow reduction, before being hot-dip galvanized in a bath of molten zinc and optionally heat-treated to form said galvannealed steel sheet.

The aim is to form an oxidized steel sheet having an outer layer of iron oxide with a controlled thickness which will protect the steel from the selective outer oxidation of silicon, aluminium and manganese, while the steel sheet is annealed before the hot-dip galvanization.

Said oxidation of the steel sheet is performed in a direct flame furnace where the atmosphere comprises air and fuel with an air-to-fuel between 0.80 to 0.95, under conditions that allow the formation, on the surface of the steel sheet, of a layer of iron oxide having a thickness from 0.05 to 0.2 μm, and containing no superficial oxides of silicon and/or aluminium and/or, manganese.

Under these conditions, internal selective oxidation of silicon, aluminium and manganese will develop under the iron oxide layer, and leads to a deep depletion zone in silicon, aluminium and manganese which will minimize the risk of superficial selective oxidation. An internal oxide of at least one type of oxide selected from the group consisting of Si oxide, Mn oxide, Al oxide, complex oxide comprising Si and Mn, complex oxide of Si and Al, complex oxide of Mn and Al, and complex oxide comprising Si, Mn and Al is thus formed in the steel sheet.

During the following reduction step, the internal selective oxidation of silicon, aluminium and manganese continues to grow in depth of the steel sheet, so that external selective oxide of Si, Mn and Al is avoided when the further reduction step is achieved.

The oxidation is preferably performed by heating said steel sheet in the direct flame furnace, from ambient temperature to a heating temperature T1 which is between 680 and 800° C.

When the temperature T1 is above 800° C., the iron oxide layer formed on the surface of the steel sheet will contain manganese coming from the steel, and the wettability will be impaired. If the temperature T1 is below 680° C., the internal oxidation of silicon and manganese will not be favoured, and the galvanizability of the steel sheet will be insufficient.

With an atmosphere having a ratio air-to-fuel less than 0.80, the thickness of the layer of iron oxide will not be sufficient to protect the steel from a superficial oxidation of silicon, manganese and aluminium during the reduction step, and the risk of formation of a superficial layer of oxides silicon and/or aluminium and/or manganese, possibly in combination with iron oxide is high during the reduction step. However, with a ratio air-to-fuel above 0.95, the layer of iron oxide is too thick, and requires a higher hydrogen content in the soaking zone to be completely reduced which is cost effective. Thus, the wettability will be impaired in both cases.

According to the invention, despite the thin thickness of the layer of iron oxide, the superficial oxidation of silicon, aluminium and manganese is avoided because the kinetics of reduction of this iron oxide is reduced during the reduction step compared to the conventional process where the reduction rate is about 0.02 μm/s. As a matter of fact, it is essential that the reduction of the iron oxide be performed at a reduction rate from 0.001 to 0.010 μm/s. If the reduction rate is less than 0.001 μm/s, the time required for the reduction step will not be conformed to industrial requirements. But if the reduction speed is higher than 0.010 μm/s, the superficial oxidation of silicon, aluminium and manganese will not be avoided. The development of the internal selective oxidation of silicon, aluminium and manganese is thus performed at a depth of more than 0.5 μm from the surface of the steel sheet, while in the conventional process, the internal selective oxidation is performed at a depth of not more than 0.1 μm from the surface of the steel sheet.

When leaving the direct flame furnace, the oxidized steel sheet is reduced in conditions permitting the achievement of the complete reduction of the iron oxide into iron. This reduction step can be performed in a radiant tube furnace or in a resistance furnace.

According to the invention, said oxidized steel sheet is thus heat treated in an atmosphere comprising from 2 to less than 15% by volume of hydrogen, and preferably from 2 to less than 5% by volume of hydrogen, the balance being nitrogen and unavoidable impurities. The aim is to slow down the rate of the reduction of the iron oxide into iron, so that the development of a deep internal selective oxidation of silicon, aluminium and manganese is favoured. It is preferable that the atmosphere in the radiant tube furnace or in the resistance furnace comprises more than 2% by volume of hydrogen in order to avoid pollution of the atmosphere in case air enters into said furnace.

Said oxidized steel sheet is heated from the heating temperature T1 to a soaking temperature T2, then it is soaked at said soaking temperature T2 for a soaking time t2, and is finally cooled from said soaking temperature T2 to a cooling temperature T3, said heat treatment being performed in one of the above atmosphere.

Said soaking temperature T2 is preferably between 770 and 850° C. When the steel sheet is at the temperature T2, a dual phase microstructure composed of ferrite and austenite is formed. When T2 is above 850° C., the volume ratio of austenite grows too much, and external selective oxidation of silicon, aluminium and manganese can occur at the surface of the steel. But when T2 is below 770° C., the time required to form a sufficient volume ratio of austenite is too high.

In order to obtain the desired TRIP effect, sufficient austenite must be formed during the soaking step, so that sufficient residual austenite is maintained during the cooling step. The soaking is performed for a time t2, which is preferably between 20 and 180 s. If the time t2 is longer than 180 s, the austenite grains coarsen and the yield strength $R_e$ of the steel after forming will be limited. Furthermore, the hardenability of the steel is low. However, if the steel sheet is soaked for a time t2 less than 20 s, the proportion of austenite formed will be insufficient and sufficient residual austenite and bainite will not form when cooling.

The reduced steel sheet is finally cooled at a cooling temperature T3near the temperature of the bath of molten zinc, in order to avoid the cooling or the re-heating of said bath. T3 is thus between 460 and 510° C. Therefore, a zinc-based coating having a homogenous microstructure can be obtained.

When the steel sheet is cooled, it is hot dipped in the bath of molten zinc whose temperature is preferably between 450 and 500° C.

When a hot-dip galvanized steel sheet is required, the bath of molten zinc preferably contains 0.14 to 0.3% by weight of aluminium, the balance being zinc and unavoidable impurities. Aluminium is added in the bath in order to inhibit the formation of interfacial alloys of iron and zinc which are brittle and thus cannot be shaped. During immersion, a thin layer of $Fe_2Al_5$ (thickness less than 0.2 μm) is formed at the interface of the steel and of the zinc-based coating. This layer insures a good adhesion of zinc to the steel, and can be shaped due to its very thin thickness. However, if the content of aluminium is more than 0.3% by weight, the surface appearance of the wiped coating is impaired because of a too intense growth of aluminium oxide on the surface of the liquid zinc.

When leaving the bath, the steel sheet is wiped by projection of a gas, in order to adjust the thickness of the zinc-based coating. This thickness, which is generally between 3 and 20 μm, is determined according to the required resistance to corrosion.

When a hot-dip galvannealed is required, the bath of molten zinc preferably contains 0.08 to 0.135% by weight of dissolved aluminium, the balance being zinc and unavoidable impurities, and the content of molybdenum in the steel can be less than 0.01% by weight. Aluminium is added in the bath in order to deoxidize the molten zinc, and to make it easier to control the thickness of the zinc-based coating. In that condition, precipitation of delta phase ($FeZn_7$) is induced at the interface of the steel and of the zinc-based coating.

When leaving the bath, the steel sheet is wiped by projection of a gas, in order to adjust the thickness of the zinc-based coating. This thickness, which is generally between 3 and 10 μm, is determined according to the required resistance to corrosion. Said zinc-based coated steel sheet is finally heat-treated so that a coating made of a zinc-iron alloy is obtained, by diffusion of the iron from steel into the zinc of the coating.

This alloying treatment can be performed by maintaining said steel sheet to at a temperature T4 between 460 and 510° C. for a soaking time t4 between 10 and 30 s. Thanks to the absence of external selective oxidation of silicon and manganese, this temperature T4 is lower than the conventional alloying temperatures. For that reason, large quantities of molybdenum to the steel are not required, and the content of molybdenum in the steel can be limited to less is than 0.01% by weight. If the temperature T4 is below 460° C., the alloying of iron and zinc is not possible. If the temperature T4 is above 510° C., it becomes difficult to form stable austenite, because of the unwished carbide precipitation, and the TRIP effect cannot be obtained. The time t4 is adjusted so that the average iron content in the alloy is between 8 and 12% by weight, which is a good compromise for improving the weldability of the coating and limiting the powdering while shaping.

The invention will now be illustrated by examples given by way of non-limiting indication.

Trials were carried out using 0.8 mm thick, 1.8 m width steel sheet A, B and C manufactured from steel whose composition is given in the table 1.

Table I: chemical composition of the steel of sheets A, B and C, in % by weight, the balance of the composition being iron and unavoidable impurities (sample A and B).

TABLE I

| C | Mn | Si | Al | Mo | Cr | P | Ti | V | Ni | Nb |
|---|---|---|---|---|---|---|---|---|---|---|
| 0.20 | 1.73 | 1.73 | 0.01 | 0.005 | 0.02 | 0.01 | 0.005 | 0.005 | 0.01 | 0.005 |

The aim is to compare the wettability and the adherence zinc-coating to steel sheet, of steel sheet treated according to the invention, to the one treated with conditions which are outside the scope of the invention.

The wettability is visually controlled by an operator. The adherence of the coating is also visually controlled after a 180° bending test of samples.

EXAMPLE 1

According to the Invention

Steel sheet A is continuously introduced in a direct flame furnace, in which it is brought into contact with an atmosphere comprising air and fuel with an air-to-fuel ratio of 0.94, from ambient temperature (20° C.) to 700° C., so that a layer of iron oxide having a thickness of 0.073 μm is formed. It is subsequently and continuously annealed in a radiant tube furnace, where it is heated from 700° C. to 850° C., then it is soaked at 850° C. for 40 s, and finally it is cooled to 460° C.

The atmosphere in the radiant tube furnace comprises 4% by volume of hydrogen, the balance being nitrogen and unavoidable impurities. The length of the radiant tube furnace is 60 m, the sheet speed is 90 m/min, and the gas flow rate is 250 $Nm^3/h$. Under these conditions, the reduction rate of the iron oxide layer is 0.0024 μm/s. Consequently, the reduction of the iron oxide layer lasts during the residence time of the sheet in the radiant tube furnace, and at the exit of said furnace, the iron oxide is completely reduced. No external selective oxide of Al, Si and Mn have been formed, on the contrary the internal selective oxide of Al, Si and Mn formed during the residence in the direct flame furnace have been formed more in depth in the steel sheet.

After cooling, steel sheet A is hot dip galvanized in a molten zinc-based bath comprising 0.2% by weight of aluminium, the balance being zinc and unavoidable impurities. The temperature of said bath is 460° C. After wiping with nitrogen and cooling the zinc-based coating, the thickness of the zinc-based coating is 7 μm. It is observed that the wettability is perfect, because the zinc-coating layer is continuous and the aspect surface is very good, and the adherence is good.

Furthermore, the inventors have observed that the microstructure of the steel was a TRIP microstructure comprising ferrite, residual austenite and martensite.

COMPARATIVE EXAMPLE 1

Steel sheet B is continuously introduced in a direct flame furnace, in which it is brought into contact with an atmosphere comprising air and fuel with an air-to-fuel ratio of 0.94, from ambient temperature (20° C.) to 700° C., so that a layer of iron oxide having a thickness of 0.073 μm is formed. It is subsequently and continuously annealed in a radiant tube furnace, where it is heated from 700° C. to 850° C., then it is soaked at 850° C. for 40 s, and finally it is cooled to 460° C. The atmosphere in the radiant tube furnace comprises 5% by volume of hydrogen, the balance being nitrogen and unavoidable impurities. The length of the radiant tube furnace is 60 m, the sheet speed is 90 m/min, and the gas flow rate is 400 $Nm^3/h$. Under these conditions, the reduction rate of the iron oxide layer is 0.014 μm/s. Consequently, the iron oxide layer is completely reduced in the first 10 m of the radiant tube furnace, and a layer of external selective oxide is of Al, Mn and Si is formed on the steel sheet in the last 50 m of the radiant tube furnace.

After cooling, steel sheet B is hot dip galvanized in a molten zinc-based bath comprising 0.2% by weight of aluminium, the balance being zinc and unavoidable impurities. The temperature of said bath is 460° C. After wiping with nitrogen and cooling the zinc-based coating, the thickness of the zinc-based coating is 7 μm. The inventors have observed that the microstructure of the steel is a TRIP microstructure comprising ferrite, residual austenite and martensite. However, they observed that the wettability is not perfect, because the zinc-coating layer is not continuous, the aspect surface is rather poor and the adherence is poor.

COMPARATIVE EXAMPLE 2

Steel sheet C is continuously introduced in a direct flame furnace, in which it is brought into contact with an atmosphere comprising air and fuel with an air-to-fuel ratio of 0.94, from ambient temperature (20° C.) to 700° C., so that a layer of iron oxide having a thickness of 0.073 μm is formed.

It is subsequently and continuously annealed in a radiant tube furnace, where it is soaked at 700° C. for 20 s, and finally it is cooled to 460° C. The atmosphere in the radiant tube furnace comprises 5% by volume of hydrogen, the balance being nitrogen and unavoidable impurities.

The length of the radiant tube furnace is 60 m, the sheet speed is 180 m/min, the gas flow rate is 100 $Nm^3/h$, and the reduction rate of the iron oxide layer is 0.0006 μm/s. Under these conditions, the inventors have observed, that the iron oxide layer is not reduced in the radiant tube furnace.

After cooling, steel sheet C is hot dip galvanized in a molten zinc-based bath comprising 0.2% by weight of aluminium, the balance being zinc and unavoidable impurities. The temperature of said bath is 460° C. After wiping with nitrogen and cooling the zinc-based coating, the thickness of the zinc-based coating is 7 μm.

It is observed that the TRIP microstructure is not obtained. Furthermore, the wettability is not perfect, because the zinc-coating layer is not continuous, and the adherence is poor.

The invention claimed is:

1. A process for manufacturing a hot-dip galvanized or galvannealed steel sheet having a TRIP microstructure comprising ferrite, residual austenite and optionally martensite, bainite or a mixture thereof, wherein a composition of the steel sheet comprises Fe and: by weight $0.01 \leqq C \leqq 0.22\%$ $0.50 \leqq Mn \leqq 2.0\%$ $0.2 \leqq Si \leqq 2.0\%$ $0.005 \leqq Al \leqq 2.0\%$ Mo<1.0%
Cr≦1.0%
P<0.02%
Ti≦0.20%
V≦0.40%
Ni≦1.0%
Nb≦0.20%
and unavoidable impurities resulting from smelting, wherein the process comprises:
oxidizing said steel sheet in a direct flame furnace where an atmosphere comprises air and fuel with an air-to-fuel ratio between 0.80 and 0.95;
forming a layer of iron oxide having a thickness from 0.05 to 0.2 μm on the surface of the steel sheet;
forming at least one internal oxide of Si oxide, Mn oxide, Al oxide, complex oxide comprising Si and Mn, complex oxide of Si and Al, complex oxide comprising Mn and Al, and complex oxide comprising Si, Mn and Al;
reducing said layer of iron oxide, at a reduction speed from 0.001 to 0.01 μm/s;
growing the internal oxide in depth of steel sheet;
completing the reduction of the layer of iron oxide;
hot-dip galvanizing said reduced steel sheet to form a zinc-coated steel sheet; and
optionally, subjecting said hot-dip coated steel sheet to an alloying treatment to form a galvannealed steel sheet.

2. The process according to claim 1, wherein said steel sheet comprises, by weight, P<0.015%.

3. The process according to claim 1, wherein said steel sheet comprises, by weight, Mo≦0.01%.

4. The process according to claim 1, comprising oxidizing the steel sheet by heating the steel sheet from ambient temperature to a heating temperature T1.

5. The process according to claim 4, wherein said temperature T1 is between 680 to 800° C.

6. The process according to claim 1, wherein the reduction of said layer of iron oxide comprises a heat treatment performed in a furnace having an atmosphere comprising from 2 to less than 15% by volume of hydrogen, the balance of the composition being nitrogen and unavoidable impurities.

7. The process according to claim 6, wherein the atmosphere comprises from 2 to less than 5% by volume of hydrogen.

8. The process according to claim 6, wherein said heat treatment comprises heating from the heating temperature T1 to a soaking temperature T2, soaking at said soaking temperature T2 for a soaking time t2, and cooling from said soaking temperature T2 to a cooling temperature T3.

9. The process according to claim 8, wherein said soaking temperature T2 is between 770 and 850° C.

10. The process according to claim 8, wherein said soaking time t2 is between 20 and 180 s.

11. The process according to claim 8, wherein said cooling temperature T3 is between 460 to 510° C.

12. The process according to claim 8, wherein said reduction is performed in a radiant tube furnace or in a resistance furnace.

13. The process according to claim 1, wherein the process manufactures a hot-dip galvanized steel sheet and the hot-dip galvanizing is performed by hot-dipping said reduced steel sheet in a molten bath comprising from 0.14 to 0.3% by weight of aluminium, the balance being zinc and unavoidable impurities.

14. The process according to claim 13, wherein the temperature of said molten bath is between 450 and 500° C.

15. The process according to claim 1, wherein, the process manufactures a hot-dip galvannealed steel sheet and the hot-dip galvanizing is performed by hot-dipping said reduced steel sheet in a molten bath comprising from 0.08 to 0.135% by weight of aluminium, the balance being zinc and unavoidable impurities.

16. The process according to claim 15, wherein molybdenum of said steel sheet is less than 0.01% by weight.

17. The process according to claim 15, wherein said alloying treatment is performed by heating said zinc coated steel sheet at a temperature T4between 460 and 510° C. for a soaking time t4 between 10 and 30 s.

* * * * *